US007059398B2

(12) United States Patent
Jung et al.

(10) Patent No.: US 7,059,398 B2
(45) Date of Patent: Jun. 13, 2006

(54) SOLDERED HEAT EXCHANGER

(75) Inventors: Patrick Jung, Roth (FR); Fabrice Kaczmarek, Saverne (FR); Gilles Vigo, Rupt sur Moselle (FR); Sylvain Louis, Metz (FR)

(73) Assignee: Behr France Hambach, Hambach Cedex (FR)

( * ) Notice: Subject to any disclaimer, the term of this patent is extended or adjusted under 35 U.S.C. 154(b) by 0 days.

(21) Appl. No.: 10/508,251

(22) PCT Filed: Feb. 27, 2003

(86) PCT No.: PCT/EP03/02041

§ 371 (c)(1),
(2), (4) Date: Sep. 20, 2004

(87) PCT Pub. No.: WO03/078912

PCT Pub. Date: Sep. 25, 2003

(65) Prior Publication Data

US 2005/0126771 A1 Jun. 16, 2005

(30) Foreign Application Priority Data

Mar. 20, 2002 (DE) ..... 102 12 306

(51) Int. Cl.
*F28F 9/02* (2006.01)

(52) U.S. Cl. ..... 165/173; 29/890.052; 228/183
(58) Field of Classification Search ..... None
See application file for complete search history.

(56) References Cited

U.S. PATENT DOCUMENTS

| | | | | |
|---|---|---|---|---|
| 4,936,381 | A * | 6/1990 | Alley | 165/176 |
| 5,042,578 | A * | 8/1991 | Tanabe | 165/174 |
| 5,209,292 | A * | 5/1993 | Arneson et al. | 165/176 |
| 5,236,044 | A * | 8/1993 | Nagasaka et al. | 165/176 |
| 6,234,238 | B1 * | 5/2001 | Koyama et al. | 165/78 |
| 6,896,044 | B1 * | 5/2005 | Kato | 165/175 |
| 2004/0050540 | A1 * | 3/2004 | Kato et al. | 165/153 |

FOREIGN PATENT DOCUMENTS

| | | |
|---|---|---|
| DE | 43 25 421 A1 | 2/1995 |
| DE | 43 39 952 A1 | 6/1995 |
| EP | 0 584 993 A1 | 3/1994 |
| EP | 1 046 876 A2 | 10/2000 |
| GB | 2 285 858 A | 7/1995 |

* cited by examiner

*Primary Examiner*—Allen J. Flanigan
(74) *Attorney, Agent, or Firm*—Foley & Lardner LLP

(57) ABSTRACT

The invention relates to a soldered heat exchanger, especially a capacitor for a motor vehicle ventilation system, comprising a heat exchanger network made of tubes and ribs and at least one collector pipe made of a base (2) and a cover (3) and separating walls (8), whereby the base (2) and the cover (3) have edges (4, 5, 6, 7) which overlap on the longitudinal sides thereof. The base (2) receives the ends of the tubes and the separating walls (8) are fixed in relation to the cover (3) by means of a first and second shoulder (8*b*, 8*c* and a lug (8*a*). According to the invention, groove-shaped recesses (3*b*, 3*c*) are arranged in the edges (6, 7) of the cover (3) in the region of the separating walls (8), wherein the shoulders (8*b*, 8*c*) of the separating walls (8) engage. A secure positioning of the separating walls in the collector pipe is obtained in addition to a leakage-free soldering of the capacitor.

4 Claims, 4 Drawing Sheets

SOLDERED HEAT EXCHANGER

Figure 1:
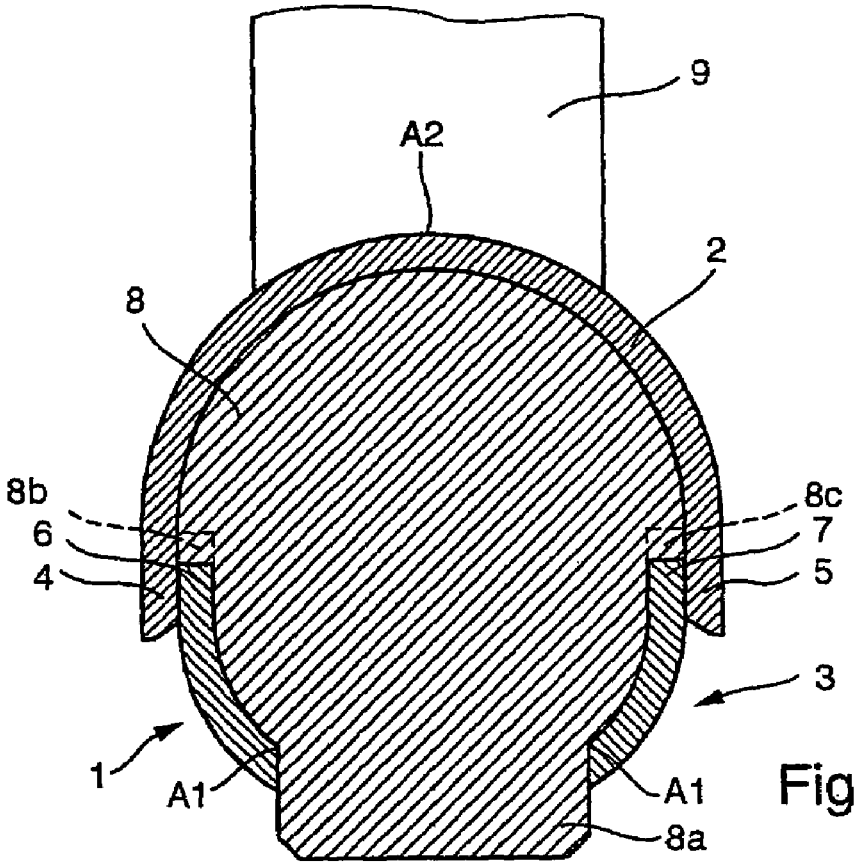

The invention relates to a soldered heat exchanger, in particular a soldered condenser for a motor vehicle air conditioning system, according to the preamble of patent claims 1 and 2, known from DE-A 43 39 952.

The known heat exchanger is what is known as a flat tube condenser which consists of flat tubes, of corrugated ribs arranged between these and of two-part headers with partitions. All the parts, which consist of an aluminum alloy, are first joined mechanically and then soldered in a soldering furnace. The partitions are inserted as separate individual parts into the headers and are positioned there. The headers consist of a dish-shaped bottom which receives the tubes and of a likewise dish-shaped cover which has slots for receiving and positioning the partitions. When these three parts, that is to say the bottom, the partitions and the cover, are being joined together, tolerance problems may arise, because the partitions, on account of their geometric design, bear against the bottom at one point, but against the cover at two points, and this may lead to a static overdetermination of these three parts and consequently to leaks after the soldering process.

The object of the present invention is to improve a positioning and fastening of the partitions in the header of the condenser initially mentioned, to the effect that a correct positioning of the partition in the header and leakage-free soldering are ensured.

This object is achieved, for the heat exchanger initially mentioned, by means of the features of patent claims 1 and 2. Accordingly, the cover of the header has at its edges, in the region of the partitions, cutouts into which the partitions engage, that is to say each partition forms with the cover a joining connection at two points (claim 1) or at three points (claim 2): by means of the twofold joining connection according to claim 1 between the steps of the partition and the cutouts in the cover, the partition is already fixed sufficiently, and a tap, as it may be referred to, such as is present in the prior art, may be dispensed with. In the alternative solution according to claim 2, the partition has, as is known, a tab which is introduced into the corresponding slot of the cover. The steps of the partition insert themselves into the edge cutouts of the cover, so that a "three-point mounting" for the partition is afforded after the joining operation. The partition can therefore no longer tilt, but is oriented exactly, that is to say at an angle of 90°, to the longitudinal axis. The dimensions of the partition and of the edge cutouts in the cover are selected such that the partition rests inside the cover, but not with its steps in the cutouts. After the partitions and the cover have been joined together, the bottom is pushed over the cover, together with the premounted partitions, into abutment against the partitions and, as is known, is secured by means of punch blows. The bottom therefore then bears with its inner face against the partition at only one point. This results, overall, in a statically determinate system of cover, partition and bottom, that is to say there are unequivocal bearing faces with minimal gaps, so that leakage-free soldering can be achieved.

In a further refinement of the invention, some play is provided between the steps of the partition and the base surface of the edge cutouts. This ensures that there is only one bearing face in each case between the partition, on the one hand, and the cover and bottom, on the other hand. The gap defined by tolerance is filled with solder material during the soldering process and thus results in leaktight soldering.

Figure 1A:
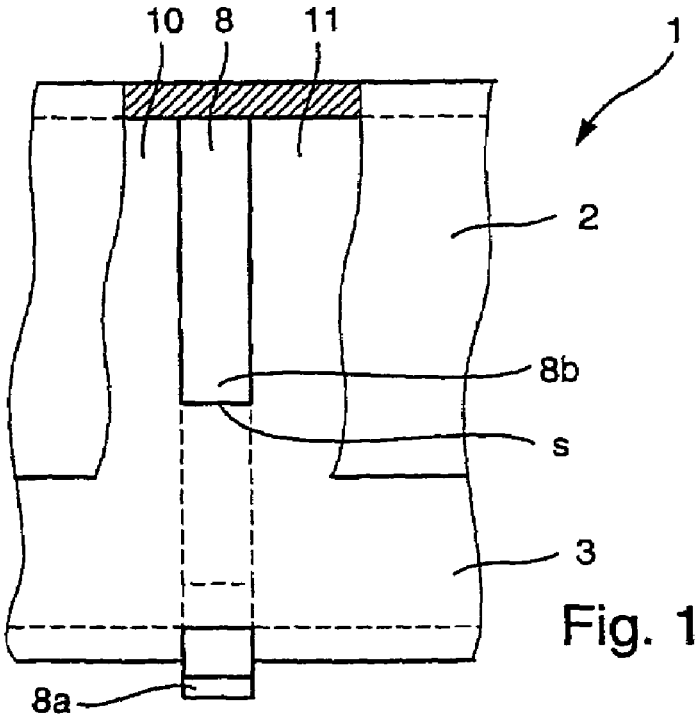
Figure 2:
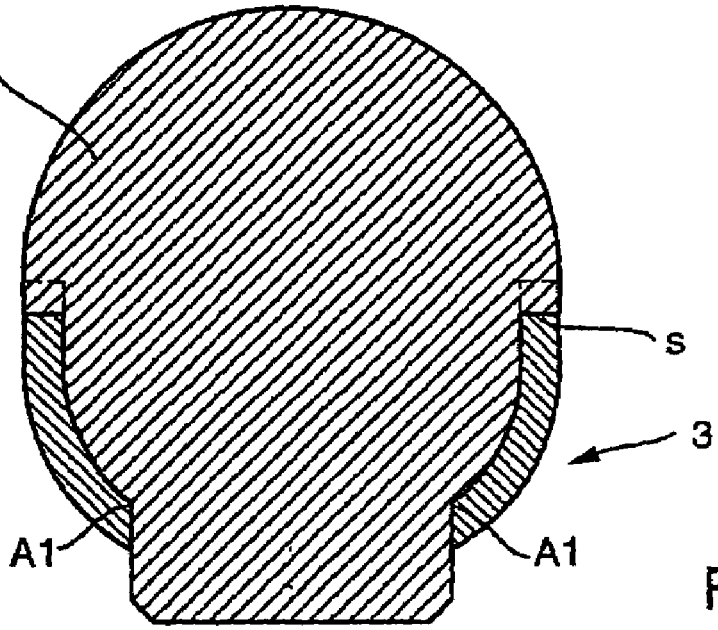
Figure 2A:
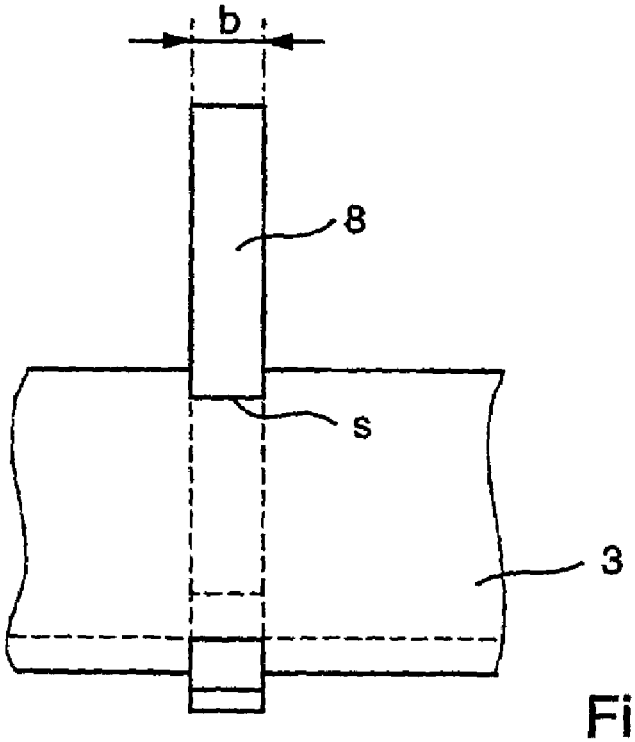
Figure 3:
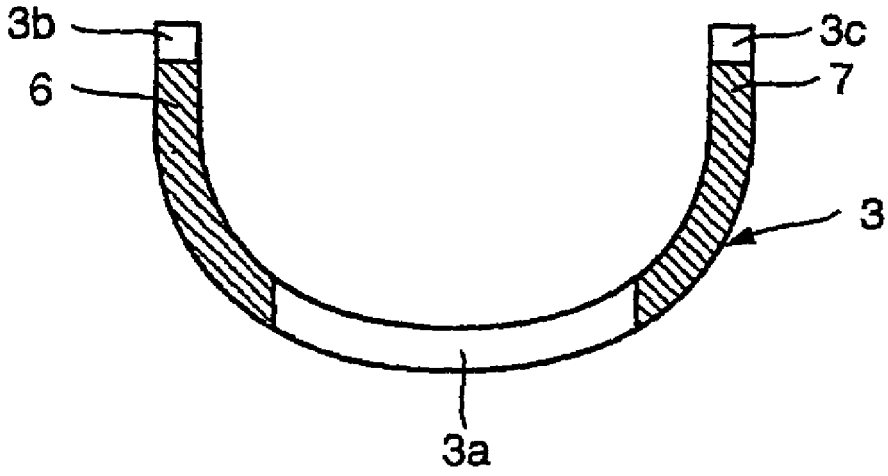
Figure 3A:
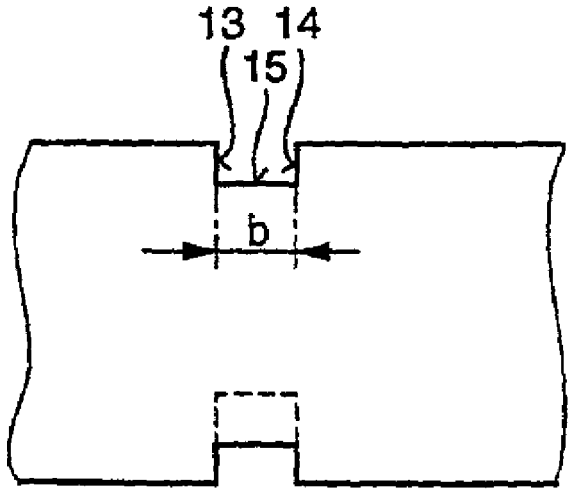
Figure 4:
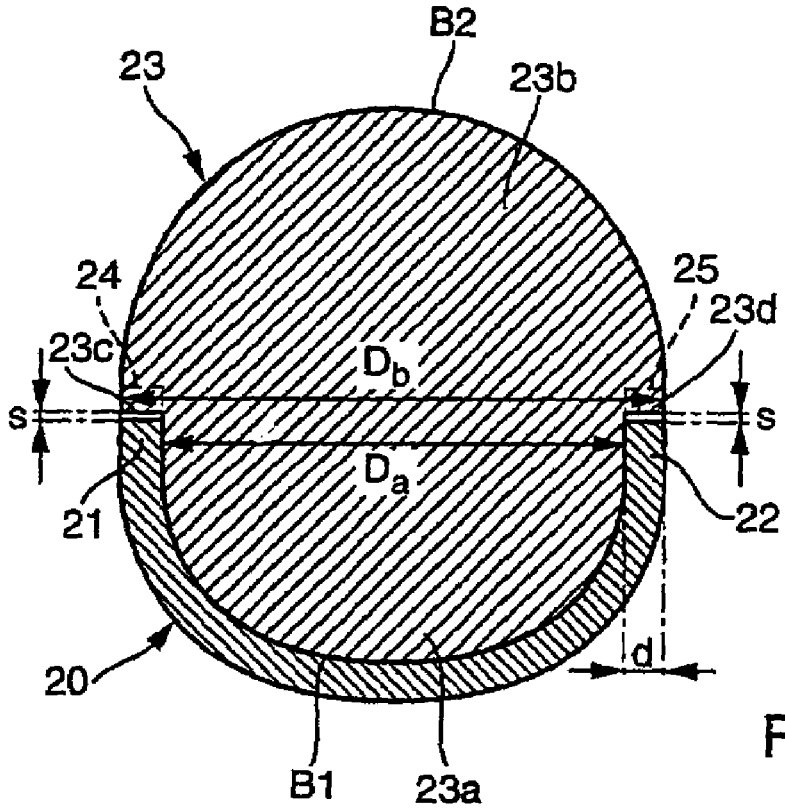
Figure 4A:
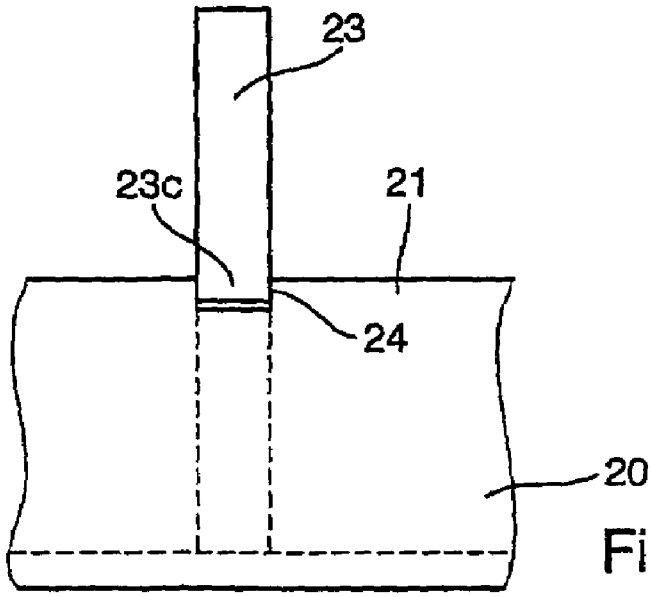

Exemplary embodiments of the invention are illustrated in the drawing and are described in more detail below. In the drawings:

FIG. 1 shows a cross section through a header with a partition,

FIG. 1*a* shows a side view of FIG. 2,

FIG. 2 shows a cross section through the cover and the partition of the header, FIG. 2*a* shows a side view of FIG. 2, FIG. 3 shows a cross section through the cover of the header in the plane of the partition, FIG. 3*a* shows a side view of FIG. 3 and FIG. 4, 4*a* show a modified embodiment with a partition without "tab".

FIG. 1 shows a cross section through a header 1, the cross section of which is delimited by a dish-shaped semicylindrical bottom 2 and a likewise dish-shaped semicylindrical cover 3 which is configured in terms of its outer dimension in such a way that it can be inserted into the bottom 2. The bottom 2 has two edge regions 4, 5 which run in the longitudinal direction of the tube (perpendicularly to the drawing plane) and which overlap with edge regions 6, 7 of the cover 3. The cross section of the header 1, thus formed by the bottom 2 and the cover 3, is filled with a partition 8 which, in its region facing the cover 3, has a tab 8*a* which passes outward through a recess 3*a* (cf. FIG. 3) of the cover 3. Furthermore, the partition 8 has two steps 8*b*, 8*c* in the region of the edges 6, 7 of the cover 3. The bottom 2 receives, in a way not illustrated in any more detail (for example, in rim holes), flat tubes 9 which, together with corrugated ribs, not illustrated, form the network of a condenser for a motor vehicle air conditioning system.

FIG. 2 and FIG. 2*a* show the header 1 without the cover 2, that is to say only with the bottom 3 and the partition 8 which has a width b.

FIG. 3 and FIG. 3*a* show the cover 3 as an individual part, and, on the one hand, the slot 3*a* for receiving the tabs 8*a*, not illustrated here, and, on the other hand, the two cutouts 3*b*, 3*c* in the edges 6, 7 of the bottom 3 can be seen here. The cutouts 3*b*, 3*c* have a U-shaped design, that is to say are open outward, and have two parallel side faces 13, 14 and a base surface 15 running perpendicularly to these. The distance between the two side faces 13, 14 has the dimension b which corresponds to the width b of the partition 8.

The assembly of the header 1 is carried out as follows: first, the partitions 8 are inserted into the cover 3, specifically first introduced with their tab 8*a* into the slots 3*a*. After a short introduction travel, the steps 8*b*, 8*c* engage into the groove-shaped incisions 3*b*, 3*c*, that is to say the partition portions 8*b*, 8*c* slide in the manner of a feather key into a groove. The introduction movement of the partition 8 is terminated when the abutment point A1 inside the cover is reached. In this position, there is still some air, that is to say a minimal gap s (cf. FIGS. 1*a* and 2), located between the steps 8*b*, 8*c* and the base surface 15 of the incisions 3*b*, 3*c*. This ensures that the partition 8 is always moved up to the abutment A1. Owing to the tolerances between the partition 8, 8*a* and the slot 3*a* and also the incisions 3*c*, 3*b*, the partition 8 is clamped slightly in this position, so that it is fixed. The bottom 2 is thereafter pushed onto the cover 3 (or the cover 3 together with the partition 8 is pushed into the bottom 2). This pushing-in movement takes place until the partition 8 touches the abutment point A2 inside the cover 2. This ensures that the partition 8 has only one abutment point, to be precise A2, with the bottom 2. The result of this is that the partition 8 can come to bear over the full circumference both with respect to the inner wall of the cover 2 and with respect to the inner wall of the bottom 3. Furthermore, by means of the three-point mounting already mentioned above, the partition 8 is also oriented perpendicularly to the longitudinal axis, that is to say the circumferential surface of the partition 8 runs parallel to the inner wall of the cover 3 and bottom 2. These are the preconditions for satisfactory soldering. The gap s existing between the steps 8*b*, 8*c* and the base line 15 of the incisions 3*b*, 3*c* is filled with solder during the soldering process and, moreover, is covered outwardly by the overlapping edge regions 4, 5 of the bottom, so that there is leaktightness both outwardly and between the two adjacent chambers 10 and 11.

After the partitions 8, cover 3 and bottom 2 have been joined together, the edge regions 4/6 and 5/7 overlapping one another may be secured by means of punch blows, as is known from the prior art initially mentioned. The entire condenser is thereafter soldered in the furnace.

FIGS. 4 and 4*a* show a further exemplary embodiment of the invention with a modified partition form in an illustration similar to FIGS. 2 and 2*a*. FIG. 4 shows, in a cross section, a cover 20 of a header, not fully illustrated. The cover 20 has an approximately semioval cross section and is delimited upwardly (in the drawing) by edge regions 21, 22. In these edge regions 21, 22 are arranged, in each case at the points where a partition is provided, groove-like incisions 24, 25 which are illustrated by broken lines in FIG. 4, only the front incision 24 appearing in FIG. 4*a*. The free cross section of the cover 20 has inserted into it a partition 23 which with its lower half 23*a* bears over its entire circumference against the inner face of the cover 20. The upper half 23*b* of the partition 23 has a diameter Db larger by double the wall thickness d than the lower half 23*a* having a diameter Da. The two cross-sectional halves 23*a* and 23*b* merge one into the other in each case via a step 23*c*, 23*d*. The steps 23*c*, 23*d* engage into the incisions 24, 25 and thus form a twofold joining connection between the partition 23 and cover 20; this is sufficient for positioning the partition 23. In contrast to the previous exemplary embodiment, illustrated in FIGS. 1 to 3, the partition 23 has no tab inserted through a slot in the cover. Instead, the cover 20 has a continuous cross section, that is to say a cross section not interrupted by slots. Consequently, the insertion of the partition through the cover and subsequent soldering are dispensed with, that is to say the risk of a leakage is further reduced.

The partition 23 is mounted by being inserted with its smaller half 23*a* into the cover 20*a*, so that the partition 23 forms with cover 20 a common abutment face B1. So that abutment or contact occurs definitively in the region B1, a gap s is left between the edge regions 21, 22 and the steps 23*c*, 23*d*. The steps 23*c*, 23*d* thus insert themselves into the groove-like cutouts 24, 25 of the cover 20 in the manner of a feather key/groove connection.

To complete the header, a bottom, not illustrated here, is pushed over the cover 20, with the partition 23 inserted, in similar way to the exemplary embodiment according to FIG. 1, so that an abutment face B2 is formed between the partition 23 and the bottom, not illustrated. This results, for mounting the entire header consisting of the cover 20, partition 23 and bottom, not illustrated, because of only two abutment faces B1, B2, in defined abutment conditions, that is to say a leakage-free soldering of the partition 23 in the header.

The invention claimed is:

1. A soldered heat exchanger, in particular a refrigerant condenser, comprising a heat exchanger network consisting of tubes and ribs and comprising at least one header which consists of a bottom and a cover and of partitions, the bottom and cover having edges overlapping one another along the sides, the bottom receiving the edges of the tubes, and the partitions having a first and a second step which rests on the edges of the cover, wherein the two edges of the cover have, in the region of the partitions, groove-like recesses, into which the steps of the partitions engage;

wherein after the bottom and cover have been joined together, the partitions in each case form a first bearing face with the cover and a second bearing face with the bottom, while a gap is left between the steps of the partitions and the base surface of the recess.

2. The heat exchanger as claimed in claim 1, wherein the recesses have two parallel side faces and a base surface arranged perpendicularly to these, and in that the distance between the side faces corresponds to the width of the partition.

3. A soldered heat exchanger, in particular a refrigerant condenser, comprising a heat exchanger network consisting of tubes and ribs and comprising at least one header which consists of a bottom and a cover and of partitions, the bottom and cover having edges overlapping one another along the sides, the bottom receiving the ends of the tubes, and the partitions having in each case a tab, which passes through a slot in the cover, and a first and a second step which rests on the edges of the cover, wherein the two edges of the cover have, in the region of the partitions, groove-like recesses, into which the steps of the partitions engage;

wherein after the bottom and cover have been joined together, the partitions in each case form a first bearing face with the cover and a second bearing face with the bottom, while a gap is left between the steps of the partitions and the base surface of the recess.

4. The heat exchanger as claimed in claim 2, wherein the recesses have two parallel side faces and a base surface arranged perpendicularly to these, and in that the distance between the side faces corresponds to the width of the partition.

* * * * *